US009389566B2

(12) United States Patent
Takahashi

(10) Patent No.: US 9,389,566 B2
(45) Date of Patent: Jul. 12, 2016

(54) IMAGE FORMING APPARATUS

(71) Applicant: FUJI XEROX CO., LTD., Tokyo (JP)

(72) Inventor: Nobukazu Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/272,078

(22) Filed: May 7, 2014

(65) Prior Publication Data

US 2015/0110505 A1 Apr. 23, 2015

(30) Foreign Application Priority Data

Oct. 23, 2013 (JP) ..... 2013-220640

(51) Int. Cl.
*G03G 15/00* (2006.01)

(52) U.S. Cl.
CPC ..... *G03G 15/55* (2013.01); *G03G 15/5062* (2013.01)

(58) Field of Classification Search
USPC ..... 399/15, 24
See application file for complete search history.

(56) References Cited

U.S. PATENT DOCUMENTS

2006/0061830 A1* 3/2006 Sakakibara ..... 358/448
2008/0126860 A1* 5/2008 Sampath ..... G06F 11/0733 714/25
2013/0155422 A1* 6/2013 Kuo ..... H04N 1/506 358/1.2
2014/0022575 A1* 1/2014 Takebe et al. ..... 358/1.13

FOREIGN PATENT DOCUMENTS

JP A-2012-237874 12/2012

* cited by examiner

*Primary Examiner* — Minh Phan
(74) *Attorney, Agent, or Firm* — Oliff PLC

(57) ABSTRACT

An image forming apparatus includes an image forming unit that forms an image on a recording material; a cause ascertaining unit that ascertains a cause of a streaked image that is generated in the image that is formed on the recording material by the image forming unit; and an outputting unit that outputs information regarding the cause ascertained by the cause ascertaining unit.

5 Claims, 4 Drawing Sheets

IMAGE FORMING APPARATUS

CROSS-REFERENCE TO RELATED APPLICATIONS

This application is based on and claims priority under 35 USC 119 from Japanese Patent Application No. 2013-220640 filed Oct. 23, 2013.

BACKGROUND

Technical Field

The present invention relates to an image forming apparatus.

SUMMARY

According to an aspect of the invention, there is provided an image forming apparatus including an image forming unit that forms an image on a recording material; a cause ascertaining unit that ascertains a cause of a streaked image that is generated in the image that is formed on the recording material by the image forming unit; and an outputting unit that outputs information regarding the cause ascertained by the cause ascertaining unit.

BRIEF DESCRIPTION OF THE DRAWINGS

An exemplary embodiment of the present invention will be described in detail based on the following figures, wherein.

DETAILED DESCRIPTION

An exemplary embodiment according to the present invention will hereunder be described with reference to the attached drawings.

Figure 1:
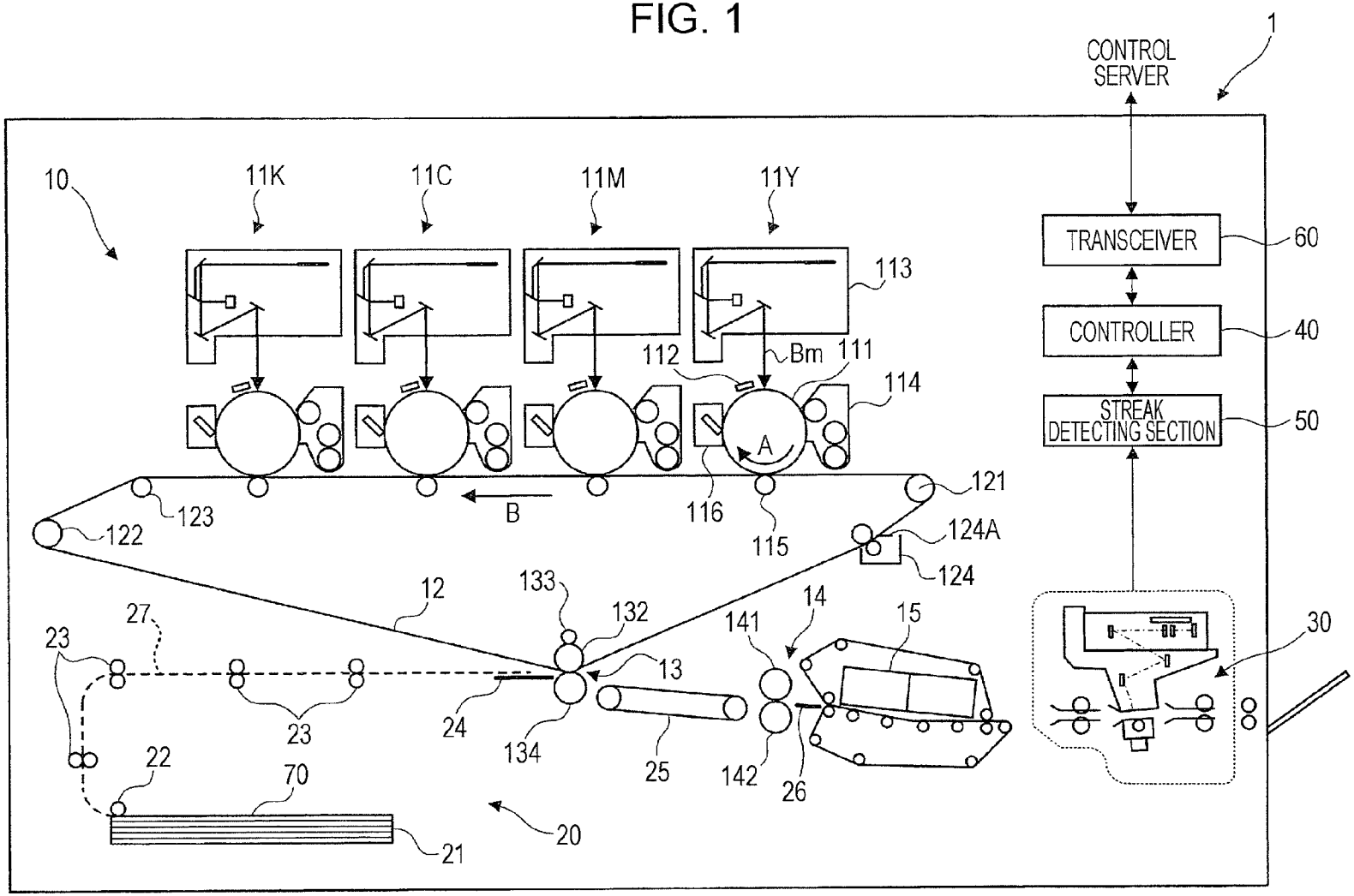
FIG. 1 schematically shows a structure of an image forming apparatus according to an exemplary embodiment of the present invention.

FIG. 1 schematically shows a structure of an image forming apparatus 1 according to an exemplary embodiment of the present invention.

The image forming apparatus 1 shown in FIG. 1 is an image forming apparatus using a tandem system, and includes an image forming section 10, a sheet transporting section 20, an image reading section 30, a controller 40, a streak detecting section 50, and a transceiver 60.

The image forming section 10, which is an exemplary image forming device, includes image forming units 11 (11Y, 11M, 11C, and 11K), an intermediate transfer belt 12, a second transfer section 13, a fixing unit 14, and a cooling unit 15.

The image forming units 11 correspond to four image forming units 11Y, 11M, 11C, and 11K corresponding to toners of four colors, yellow (Y), magenta (M), cyan (C), and black (K).

The four image forming units 11Y, 11M, 11C, and 11K are disposed side by side in a direction of movement of the intermediate transfer belt 12, and form toner images by an electrophotographic system. Each image forming unit 11 includes a photoconductor drum 111, a charging unit 112, an exposure unit 113, a developing unit 114, a first transfer member 115, and a drum cleaner 116.

The image forming units 11 form the toner images of the corresponding colors, Y, M, C and K, transfer the formed toner images to the intermediate transfer belt 12, and form on the intermediate transfer belt 12 a toner image formed by superimposing the toner images of the corresponding colors, Y, M, C and K.

Each photoconductor drum 111 rotates in the direction of arrow A in FIG. 1 at a predetermined speed. Electrostatic latent images are formed on peripheral surfaces of the photoconductor drums 111. Each charging unit 112 charges the peripheral surface of its corresponding photoconductor drum 111 to a predetermined potential. Each exposure unit 113 illuminates the peripheral surface of its corresponding charged photoconductor drum 11 with a light beam (refer to symbol Bm in FIG. 1), to form the electrostatic latent image on the peripheral surface of its corresponding photoconductor drum 111. Each developing unit 114 forms a toner image by causing toner to adhere to the electrostatic latent image formed on the peripheral surface of its corresponding photoconductor drum 111. Each first transfer member 115 transfers (first-transfers) the toner image formed on the peripheral surface of its corresponding photoconductor drum 111 to the intermediate transfer belt 12.

Here, a voltage having a polarity that is opposite to a charging polarity of the toner is applied to each first transfer member 115. This causes the toner images formed on the peripheral surfaces of the photoconductor drums 111 to be transferred to the intermediate transfer belt 12, so that a color toner image in which the toner images are superimposed upon each other is formed on the intermediate transfer belt 12. After the toner images have been transferred to the intermediate transfer belt 12 from the photoconductor drums 111, the toners (untransferred toners) adhered to the peripheral surfaces of the photoconductor drums 111 are removed by the drum cleaners 116.

The intermediate transfer belt 12 is a belt member that circulates in the direction of arrow B in FIG. 1. A drive roller 121 that is rotationally driven and moves the intermediate transfer belt 12, a tension roller 122 that applies a tension to the intermediate transfer belt 12 and prevents the intermediate transfer belt 12 from meandering, an idle roller 123 that supports the intermediate transfer belt 12, and a backup roller 132 are provided at the inner side of the intermediate transfer belt 12.

The sheet transporting section 20 is provided with a sheet accommodation section 21, a pickup roller 22, transport rollers 23, a guide member 24, a transfer belt 25, and a guide member 26. The sheet accommodating section 21 accommodates stacked sheets 70. The pickup roller 22 takes out and transports the sheets 70 accommodated in the sheet accommodating section 21 at a predetermined timing. The transport rollers 23 transport a sheet 70 that has been taken out by the pickup roller 22 along a sheet transport path 27. The guide member 24 sends the sheet 70 that has been transported by the transport rollers 23 into the second transfer section 13. The transfer belt 25 transports the sheet 70 after the second transfer to the fixing unit 14. The guide member 26 sends the sheet 70 to which the toner image has been fixed to the cooling unit 15.

The second transfer section 13 includes a second transfer roller 134 and the backup roller 132. The second transfer roller 134 is disposed in contact with an outer surface of the intermediate transfer belt 12. The backup roller 132 is disposed at an inner side of the intermediate transfer belt 12, and is an opposing electrode to the second transfer roller 134. A metallic power supply roller 133 that applies a second transfer bias to the backup roller 132 is provided. The second transfer section 13 having such a structure causes the toner image formed on the intermediate transfer belt 12 to be transferred (second transferred) to the sheet 70 that has been transported.

In the exemplary embodiment, a belt cleaner 124 that cleans the outer peripheral surface of the intermediate transfer belt 12 is provided downstream of the second transfer section 13 in the direction of movement of the intermediate transfer belt 12.

The fixing unit 14 is disposed downstream of the second transfer section 13 in the direction of transport of the sheet 70. The fixing unit 14 includes a fixing roller 141 and a pressure roller 142. The fixing roller 141 includes a heating source (not shown). The pressure roller 142 is provided so as to oppose the fixing roller 141 and presses the fixing roller 141.

When the sheet 70 that has passed through the second transfer section 13 is transported to a location between the fixing roller 141 and the pressure roller 142, an unfixed toner image on the sheet 70 is fused by the fixing roller 141 and is fixed to the sheet 70. As a result, an image formed from the toner image is formed on the sheet 70. In the exemplary embodiment, the cooling unit 15 is provided downstream of the fixing unit 14 in the direction of transport of the sheet 70. The cooling unit 15 cools the sheet 70 transported from the fixing unit 14. This causes the toner on the sheet 70 to harden.

Next, the image reading section 30 is described.

Figure 2:
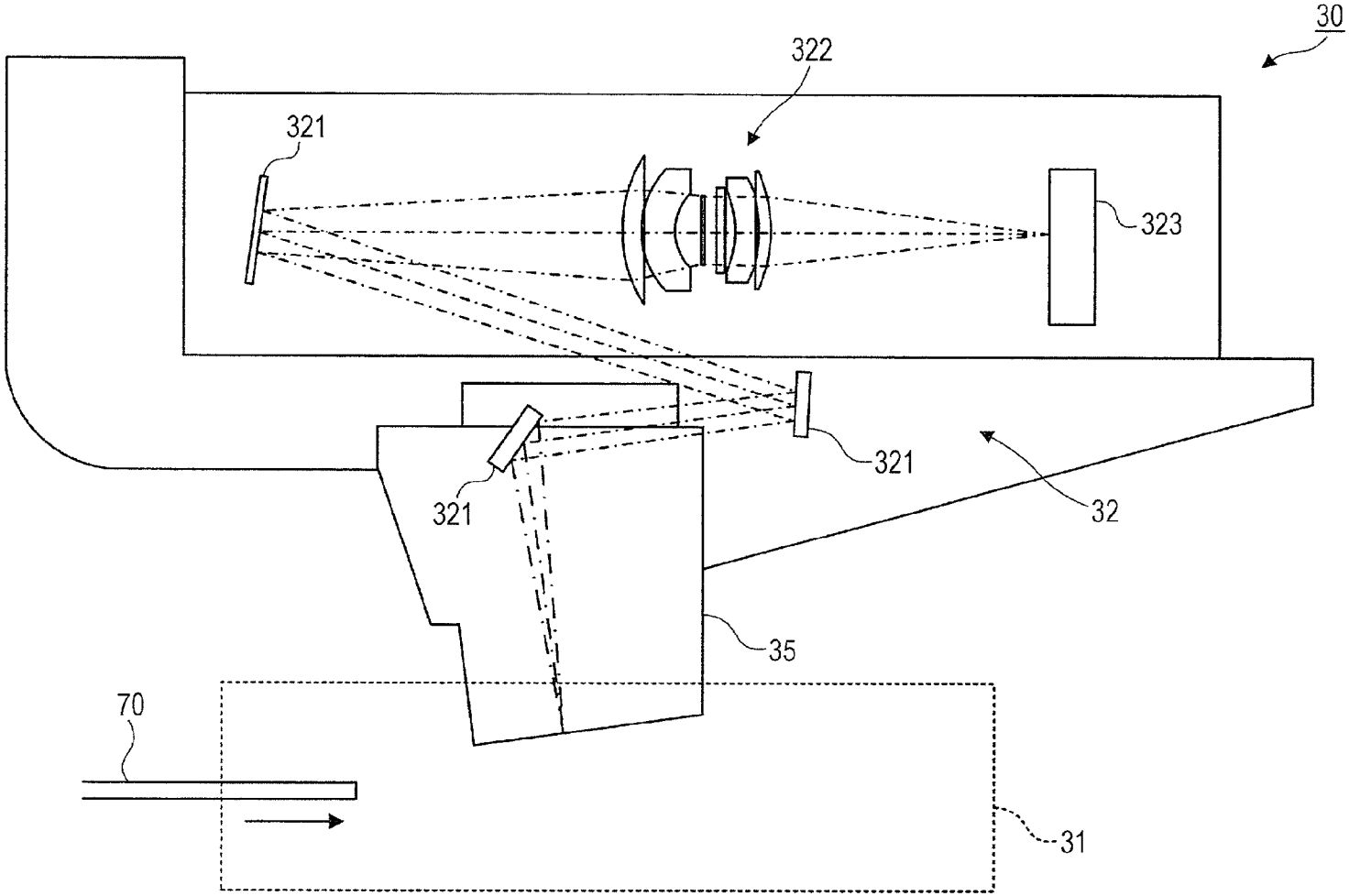
FIG. 2 is an enlarged view of an image reading section shown in FIG. 1.

FIG. 2 is an enlarged view of the image reading section 30 shown in FIG. 1.

As shown in FIG. 2, the image reading section 30 includes a passage region 31 that a sheet 70 passes and an image reader 32 that reads an image on the sheet 70 that is positioned in the passage region 31.

The image reader 32 is provided with three reflecting mirrors 321, an imaging lens 322, and an image sensor 323. The three reflecting mirrors 321 guide to the imaging lens 322 light that has been emitted from a light source (not shown), that has illuminated the sheet 70, and that has been reflected from the sheet 70. The imaging lens 322 causes the light guided from the three reflecting mirrors 321 to be focused on the image sensor 323. The image sensor 323 includes an imaging element. The image sensor 323 receives the light that has been focused by the imaging lens 322, so that image data is generated in accordance with the amount of received light.

Figure 3:
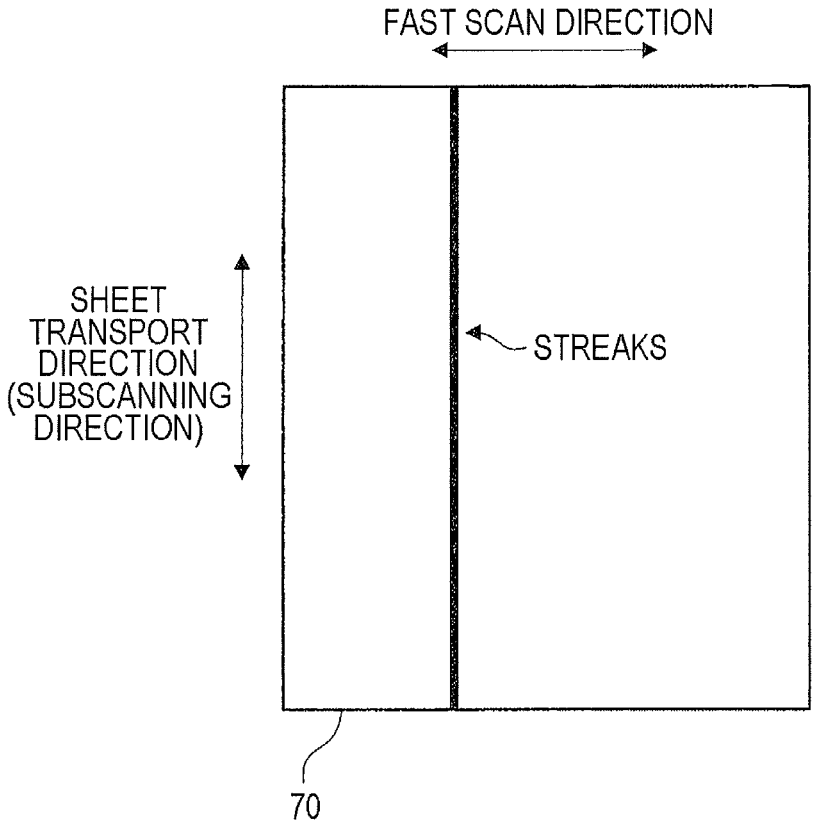
FIG. 3 shows streaks generated on a sheet.

In the image forming apparatus 1 according to the exemplary embodiment, an image streak defect (streaked image) may occur (may be generated) in an image formed on a sheet 70. In detail, as shown in FIG. 3 (which shows streaks generated on a sheet 70), the streaks may appear on the sheet 70 along a transport direction of the sheet 70.

Further, if an axial direction of each photoconductor drum 111 (see FIG. 1) is defined as a fast scan direction and a direction orthogonal to the fast scan direction is defined as a subscanning direction, streaks along the subscanning direction may appear on a sheet 70.

In the exemplary embodiment, a detection is made as to whether or not streaks have been generated along the subscanning direction. When it is detected that streaks have been generated, for example, the cause of the streaks is identified. That is, in the exemplary embodiment, the cause of the streaks is ascertained by the streak detecting section 50 that functions as a cause ascertaining unit.

Figure 4:
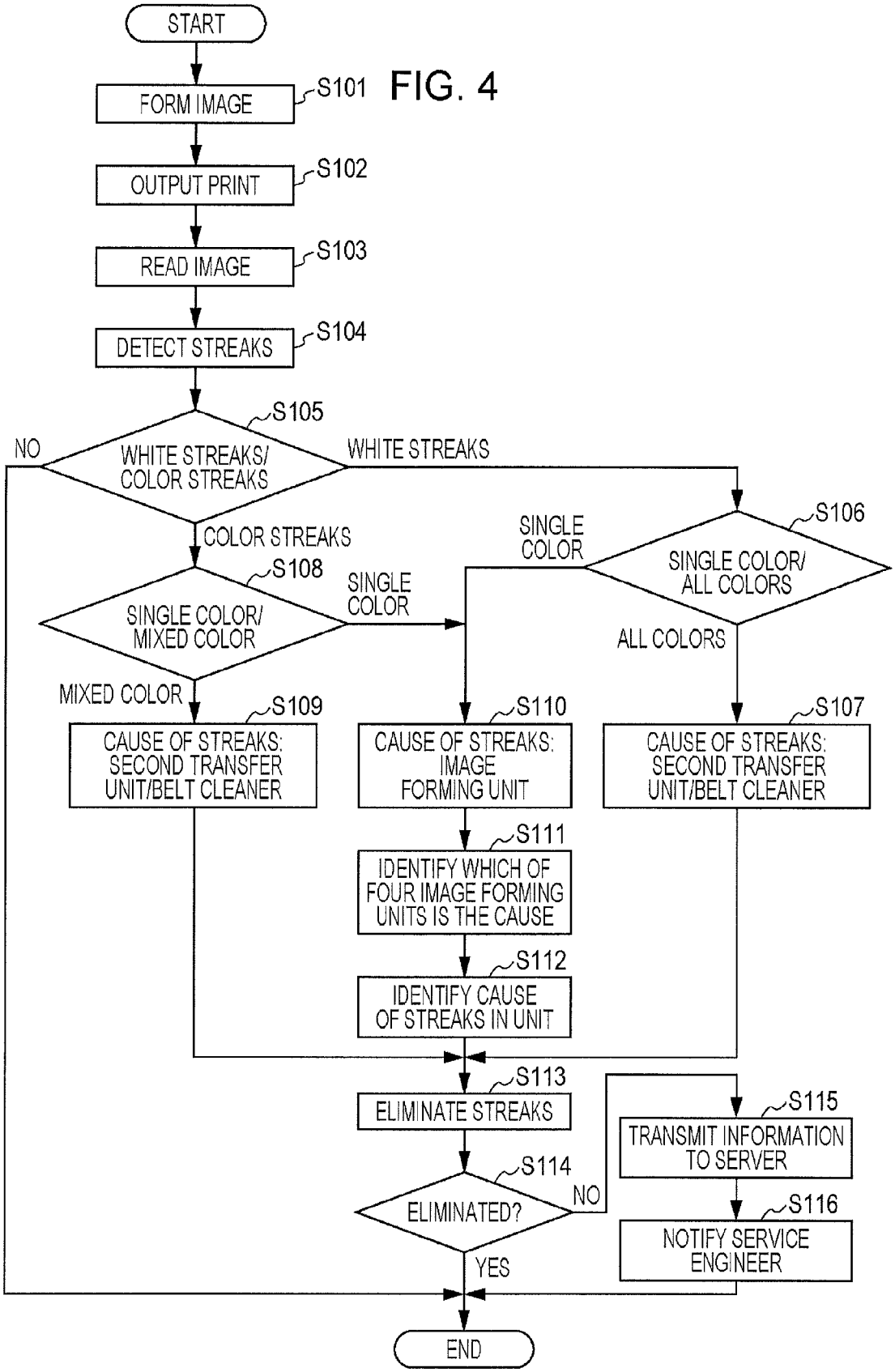
FIG. 4 is a flowchart showing the steps that are executed by the image forming apparatus according to the exemplary embodiment, the steps being related to, for example, detecting streaks.

FIG. 4 shows the steps that are executed by the image forming apparatus 1 according to the exemplary embodiment, the steps being related to, for example, detecting streaks.

In the image forming apparatus 1 according to the exemplary embodiment, at a predetermined timing, such as when turning on a power supply, an image is formed on a sheet 70 and the printed sheet is output (Steps 101 and 102). More specifically, for example, a total of five printed sheets are output.

In more detail, printed outputs in which images having predetermined image densities (such as halftone images) are formed on substantially the entire sheets 70 are provided for the corresponding colors, Y, M, C, and K. As a result, a total of four sheets 70, that is, the sheet 70 on which a yellow image is formed, the sheet 70 on which a magenta image is formed, the sheet 70 on which a cyan image is formed, and the sheet 70 on which a black image is formed, are output. Although, in the exemplary embodiment, the images are formed on the entire sheets 70, for example, belt-shaped images extending along the fast scan direction may be formed on the sheets 70.

Next, in the exemplary embodiment, one print output in which an image is not formed (that is, a print output in which charging operations by the charging units 112 (see FIG. 1) and developing operations by the developing units 114 are ordinarily formed, but exposure operations by the exposure units 113 are not performed) is performed.

By these operations, in the exemplary embodiment, a total of five sheets 70, that is, the sheet 70 on which the yellow image is formed, the sheet 70 on which the magenta image is formed, the sheet on which the cyan image is formed, the sheet 70 on which the black image is formed, and the sheet 70 on which an image is not formed are successively transported to the image reading section 30.

At the image reading section 30, the images formed on the corresponding sheets 70 are read (Step 103). As a result, in the exemplary embodiment, pieces of image data for five sheets are generated. Thereafter, in the exemplary embodiment, on the basis of the pieces of image data for the five sheets, the streak detecting section 50 (see FIG. 1) detects whether or not streaks have been generated (Step 104).

The detection of streaks is described in detail. In detecting streaks, first, the streak detecting section 50 determines whether or not white streaks or color streaks have been generated by successively analyzing the pieces of image data for the five sheets (Step 105). When the streak detecting section 50 determines that white or color streaks have not been generated, the process ends. In contrast, when the streak detecting section 50 determines that white streaks have been generated, that is, when the streak detecting section 50 determines that white streaks have been generated along the subscanning direction on any one of the four sheets 70 on which the images of the corresponding colors, Y, M, C, and K are formed, the process proceeds to Step 106.

In the operation of Step 106, it is determined whether or not white streaks have been generated on all four of the sheets 70 (white streaks have been generated with regard to all four of the colors) or whether or not white streaks (with regard to one color (single color)) have been generated on one sheet 70.

When the streak detecting section 50 determines that white streaks have been generated on all four sheets 70 (white streaks have been generated with regard to all four of the colors), the streak detecting section 50 determines that the second transfer section 13 (see FIG. 1) or the belt cleaner 124 is the cause of the streaks (Step 107). This is because, when white streaks have been generated with regard to all four of the colors, it is thought that the cause of the white streaks is the second transfer section 13 or the belt cleaner 124 that exists at a common location where the images of the corresponding colors pass.

In contrast, when, in Step 106, the streak detecting section 50 determines that white streaks are generated on one sheet 70 (with regard to one of the colors), the streak detecting section 50 determines that the cause of the streaks is the image forming unit 11 (Step 110).

Next, the streak detecting section 50 identifies which of the four image forming units 11Y, 11M, 11C, and 11K is the cause of the streaks (Step 111). For example, when the white streaks are generated on the magenta image, the magenta image forming unit 11M is identified as the image forming unit causing the streaks. Thereafter, in the exemplary embodiment, the process proceeds to Step 112.

In the exemplary embodiment, in Step 105, when the streak detecting section 50 determines that color streaks have been generated, that is, when the streak detecting section 50 determines that color streaks have been generated on the one sheet 70 on which an image is not formed, the process proceeds to Step 108. In the operation of Step 108, the streak detecting section 50 determines whether the color of the generated color streaks is a mixed color or a single color.

When the streak detecting section 50 determines that the color is a mixed color, the streak detecting section 50 determines that the cause of the streaks is the second transfer section 13 (see FIG. 1) or the belt cleaner 124 (Step 109). More specifically, if, for example, the color of the color streaks is gray, the streak detecting section 50 determines that the cause of the streaks is the second transfer section 13 (see FIG. 1) or the belt cleaner 124.

At the second transfer section 13 or the belt cleaner 124, toners of different colors are mixed. Therefore, when streaks of a mixed color are generated, the probability of the second transfer section 13 or the belt cleaner 124 being the cause of the streaks is increased.

In contrast, in Step 108, when the streak detecting section 50 determines that the color of the color streaks is a single color, the streak detecting section 50 determines that an image forming unit 11 is the cause of the streaks (Step 110). Next, the streak detecting section 50 identifies which of the four image forming units 11Y, 11M, 11C, and 11K is the cause of the streaks (Step 111). More specifically, if the color of the color streaks is magenta, the streak detecting section 50 determines that the cause of the color streaks is the magenta image forming unit 11M. In the exemplary embodiment, when the operation of Step 111 ends, the process proceeds to Step 112.

Next, the operation of Step 112 and the subsequent steps are described.

In the operation of Step 112, the streak detecting section 50 identifies which member of the members that make up the image forming unit 11 is the cause of the streaks. That is, the streak detecting section 50 identifies the member that is the cause of the streaks. More specifically, the streak detecting section 50 identifies which of the members (see FIG. 1) of the image forming unit 11, that is, the charging unit 112, the exposure unit 113, the developing unit 114, the first transfer member 115, and the drum cleaner 116, is the cause of the streaks.

Operations that are carried out for identifying the member causing the streaks are described below.

Operations that are carried out for identifying the member causing the streaks include, for example, checking of the threshold values of the members, more specifically, for example, checking of the lives of the charging unit 112, the exposure unit 113, the developing unit 114, the first transfer member 115, and the drum cleaner 116. When a parameter that increases in accordance with the use of a member, such as the amount of time of use of the member, exceeds its predetermined life (threshold value), this member whose life is exceeded is identified as the member that is the cause of the streaks.

Other operations that are carried out to identify the member causing the streaks include, for example, analyzing the streaks that are generated. Then, on the basis of the results of the analysis, the member that is the cause of the streaks is identified.

More specifically, the streaks are analyzed from the viewpoints of, for example, the color of the streaks, the width of the streaks, and edge characteristics of the streaks. On the basis of the results of the analysis, the member that is the cause of the streaks is identified.

A concrete example thereof is given. For example, when, as a result of analyzing the streaks, sharp white streaks having a width of 1 mm or less are generated, the exposure unit 113 is identified as the cause of the streaks. Further, in this case, adhesion of dirt to the exposure unit 113 is identified as the cause of the streaks.

For example, when the white streaks have a width of 1 mm or less and has a blurred edge, the charging unit 112 or the developing unit 114 is identified as the cause of the streaks. Further, in this case, adhesion of dirt to the charging unit 112 or clogging of dirt in a developer regulating member of the developing unit 114 is identified as the cause of the streaks.

Further, when, as a result of analyzing the streaks, sharp color streaks having a width of 1 mm or less and being a single color are generated, the drum cleaner 116 is identified as being the cause of the streaks. Further, in this case, adhesion of dirt to the drum cleaner 116 or a defect in part of the drum cleaner 116 is identified as being the cause of the streaks.

For example, when color streaks having a width of 1 mm or less and having a blurred edge is generated, the developing unit 114 or the charging unit 112 is identified as the cause of the streaks.

When identifying the member causing the streaks, an isolation operation may be carried out. In the isolation operation, an image is formed again on a sheet 70, and it is confirmed whether or not streaks are generated on the sheet 70.

The isolation operation is described by a concrete example. For example, by developing an image without exposure, it is possible to perform an isolation operation on the charging unit 112 and the exposure unit 113, in which case it is identified which of the charging unit 112 and the exposure unit 113 is the member causing the streaks. That is, in the isolation operation, for example, an image is formed on a sheet 70 as a result of stopping some of the members that are to be actually operated. In addition, in the isolation operation, for example, an image is formed on the sheet 70 as a result of changing operation parameters of some of the members. This allows the member that is the cause of the streaks to be identified.

More specifically, for example, exposure by the exposure unit 113 is not performed, and the charging potential provided by the charging unit 112 is made lower than an ordinary charging potential, so that the charging potential of the photoconductor drum 111 is lower than the ordinary charging potential. In this case, even though exposure is not performed by the exposure unit 113, the charging potential of the photoconductor drum 111 is the same as that when exposure is performed. In addition, in this state, development is performed using the developing unit 114. When, under such a condition, streaks are generated, it is possible to determine that the charging unit 112 is the cause of the streaks instead of the exposure unit 113.

In addition, for example, it is possible to perform an isolation operation on the charging unit 112 and the developing unit 114 by changing charging parameters (exemplary operation parameters). By this operation, it is possible to identify which of the charging unit 112 and the developing unit 114 is the member causing the streaks. More specifically, in the isolation operation, with exposure not being performed, the charging parameter of the charging unit 112 is changed (each time an image is formed on a sheet 70, the charging parameter is changed). Then, if streaks are generated when a certain charging parameter is changed, it is possible to determine that the charging unit 112 is the cause of the streaks.

In the exemplary embodiment, as described above, when white streaks are generated on the images of all four colors Y, M, C, and K, or when mixed color streaks are generated, it is determined that the second transfer section 13 or the belt cleaner 124 is the cause of the streaks. However, it is possible to determine which of the second transfer section 13 and the belt cleaner 124 is the cause of the streaks on the basis of where the streaks are generated.

For example, when streaks are generated due to a defect in part of a cleaning blade 124A (see FIG. 1) of the belt cleaner 124, the streaks are generated over the entire area from a leading end to a trailing end of a sheet. In other words, the streaks are also generated in the margins of the sheet. In this case, it is possible to determine which of the second transfer section 13 and the belt cleaner 124 is the cause of the streaks depending upon the existence or absence of the streaks in the margins of the sheet. That is, when the streaks exist in the margins of the sheet, it is possible to determine which of the second transfer section 13 and the belt cleaner 124 is the cause of the streaks.

Next, the operations after identifying the cause of the streak are described.

After identifying the cause of the white streaks or the color streaks, in the exemplary embodiment, each portion is driven by the controller 40 that functions as part of an eliminating unit, and the cause of the streaks is eliminated (Step 113).

Although not described above, the controller 40 and the streak detecting section 50 includes, for example, a central processing unit (CPU), read only memory (ROM), random access memory (RAM), and a hard disk drive (HDD), none of which are shown. The CPU executes a program stored in ROM or the HDD, so that each function, such as a control function and a streak detection function, is realized.

Here, in Step 113, in eliminating the cause of the streaks, for example, locations that are the cause of the streaks are cleaned.

More specifically, when, for example, the cause of the streaks is the charging unit 112, automatic cleaning is performed. Further, in more detail, for example, when the charging unit 112 is provided with a discharge wire, the wire is cleaned.

For example, when the exposure unit 113 is the cause of the streaks, automatic cleaning is performed. More specifically, the exposure unit 113 may be provided with a glass plate that allows light emitted from the light source to pass therethrough and that prevents entry of, for example, dust into a housing. When such a glass plate is provided, by driving a drive source, such as a motor, a cleaning member is slid along a surface of the glass plate. By sliding the cleaning member, a substance adhered to the surface of the glass plate is removed.

For example, when the drum cleaner 116 is the cause of the streaks, for example, the photoconductor drum 111 is rotated in a direction opposite to that during ordinary operation and by 45 degrees. In this case, foreign material interposed between the drum cleaner 116 and the photoconductor drum 111 is removed, so that the probability with which the cause of the streaks is eliminated is increased.

When the cause of the streaks is the developing unit 114, for example, a predetermined toner cleaning mode is executed to make it possible to eliminate the cause of the streaks. When the first transfer member 115 is the cause of the streaks, a transfer parameter is changed to make it possible to eliminate the cause of the streaks. Further, when the second transfer section 13 or the belt cleaner 124 is the cause of the streaks, an automatic cleaning cycle is executed to make it possible to eliminate the cause of the streaks.

The cause elimination operations of the causes of the streaks are described above. In the exemplary embodiment, after performing the cause elimination operation of the cause of the streaks, it is determined whether or not the cause of the streaks has been eliminated (Step 114). More specifically, the operations of Steps 101 to 104 are performed again (that is, images are formed again on five sheets 70, the images on the sheets are read again, and a detection is made again as to whether or not streaks have been generated), to determine whether or not the cause of the streaks has been eliminated. Then, when the cause of the streaks has been eliminated, the process ends.

In contrast, when it is determined that the cause of the streaks has not been eliminated (that is, the streaks have been detected in Step 104), for example, streak detection information (for example, information regarding the position of the streaks and information regarding the state of the streaks) and information regarding the cause of the streaks (member causing the streaks) are transmitted (output) to an external control server via the transceiver 60 (see FIG. 1) that functions as an outputting unit (Step 115). Thereafter, in the exemplary embodiment, the server notifies a service engineer in charge of the service (Step 116). By this, afterwards, the service engineer, for example, replaces a part, and eliminates the cause of the streaks.

Here, in the exemplary embodiment, the cause of the streaks (information regarding the member causing the streaks) is transmitted to the control server and accumulated. Therefore, the service engineer knows beforehand the cause of the streaks (the member causing the streaks) when, for example, replacing a part. In the exemplary embodiment, the service engineer is capable of speedily, for example, replace a part.

In the exemplary embodiment, prior to transmitting information to the control server, the apparatus, itself, is capable of eliminating the cause of the streaks by performing a cause elimination operation of the streaks. In this case, the cause of the streaks is eliminated without calling a service engineer. As in the exemplary embodiment, when the cause elimination operation of the streaks is not performed by the apparatus, itself, it is necessary to call a service engineer. In such a case, it may not be possible to use the image forming apparatus 1 until the service engineer arrives.

Although, in the foregoing description, for example, a service engineer replaces a part when the cause of the streaks is not eliminated, a user himself may replace the part instead of the service engineer.

More specifically, for example, when, in Step 114 (in which a determination is made after a cause elimination operation has been performed), it is determined that the cause of the streaks has not been eliminated, a user is notified via a user interface (UI) for a display panel about, for example, the necessity of replacing a part. In notifying the user, the user is notified about the member causing the streaks.

That is, when, in Step 114, it is determined that the cause of the streaks has not been eliminated, for example, streak detection information and information regarding the cause of the streaks are output to the UI from the controller 40 that functions as an outputting unit. This causes, for example, the cause of the streaks to be displayed at the UI. When such an operation is performed, the user, himself, orders a part and replaces the part causing the streaks.

In the foregoing description, a streak detection operation and a cause elimination operation are performed at a predetermined timing, such as when turning on a power supply. However, a streak detection operation or the like may be started by transmitting a signal to the image forming apparatus 1 from an external device, such as an external personal computer (PC). More specifically, when, for example, a user notifies a call center or the like that a problem has been reported, an external device transmits a signal to the image forming apparatus 1. When the image forming apparatus 1 receives the signal, for example, a streak detection operation may be started.

In the foregoing description, the case in which the images formed on the five sheets 70 are automatically read by the image reading section 30 is given as an example. However, the images formed on the five sheets 70 may be read by a different image reading device. For example, when an image reading section 30 that automatically reads images, such as that in the exemplary embodiment, is not provided, a general scanning device may be used to read the images formed on the five sheets 70.

In the foregoing description, the case in which information is transmitted to a control server (a service engineer is called) when it is determined that streaks have not been eliminated in Step 114 is given. However, in addition to or instead of transmitting this information, image formation parameters may be changed. For example, transfer electric current when first transfer is performed may be changed, or charging or exposure parameters may be changed. In this case, the generated streaks are unlikely to stand out. If it is determined that the streaks have not been eliminated in Step 114, image processing (such as image processing on image data supplied to the exposure unit 113) also makes it unlikely for the streaks to stand out.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording material;

a cause ascertaining unit that ascertains a cause of a streaked image that is generated in the image that is formed on the recording material by the image forming unit;

an outputting unit that outputs information regarding the cause ascertained by the cause ascertaining unit;

wherein the image forming unit includes a plurality of members, and wherein the cause ascertaining unit ascertains the cause based on an image formed on the recording material by the image forming unit in which an operation of at least one of the members is stopped, or based on an image formed on the recording material by the image forming unit in which an operation parameter of the at least one of the members is changed.

2. The image forming apparatus according to claim 1, further comprising an eliminating unit that eliminates the cause ascertained by the cause ascertaining unit.

3. The image forming apparatus according to claim 1, wherein the cause ascertaining unit ascertains the cause based on at least one of a color, a width, and an edge state of the streaked image formed on the recording material by the image forming unit.

4. The image forming apparatus according to claim 1, wherein the cause ascertaining unit ascertains the cause based on lives of the plurality of members that make up the image forming unit.

5. The image forming apparatus according to claim 1 wherein the cause ascertaining unit ascertains which of the plurality of members making up the image forming unit is the cause of the streaked image, wherein the outputting unit outputs information regarding the member ascertained as being the cause by the cause ascertaining unit, and wherein said cause ascertaining unit is configured to check a threshold value of each of the plurality of members that make up the image forming unit to identify which member causes the streaked image.

* * * * *